US011377933B2

(12) United States Patent
Coffin et al.

(10) Patent No.: US 11,377,933 B2
(45) Date of Patent: Jul. 5, 2022

(54) SHUNT TUBE SYSTEM FOR GRAVEL PACKING OPERATIONS

(71) Applicant: Halliburton Energy Services, Inc., Houston, TX (US)

(72) Inventors: Maxime Philippe Coffin, Frisco, TX (US); Andrew David Penno, Singapore (SG); Patrick Patchi Bourgneuf, Pau (FR)

(73) Assignee: Halliburton Energy Services, Inc., Houston, TX (US)

( * ) Notice: Subject to any disclaimer, the term of this patent is extended or adjusted under 35 U.S.C. 154(b) by 280 days.

(21) Appl. No.: 16/497,734

(22) PCT Filed: Dec. 31, 2018

(86) PCT No.: PCT/US2018/068170
§ 371 (c)(1),
(2) Date: Sep. 25, 2019

(87) PCT Pub. No.: WO2020/142076
PCT Pub. Date: Jul. 9, 2020

(65) Prior Publication Data

US 2021/0332675 A1 Oct. 28, 2021

(51) Int. Cl.
*E21B 43/04* (2006.01)
*E21B 43/08* (2006.01)

(52) U.S. Cl.
CPC ..... *E21B 43/045* (2013.01); *E21B 43/08* (2013.01)

(58) Field of Classification Search
CPC ..... E21B 43/045; E21B 43/08
See application file for complete search history.

(56) References Cited

U.S. PATENT DOCUMENTS

| | | | | |
|---|---|---|---|---|
| 6,588,506 | B2 | 7/2003 | Jones | |
| 8,789,612 | B2 | 7/2014 | Haeberle et al. | |
| 2004/0140089 | A1 | 7/2004 | Gunneroed | |
| 2007/0084601 | A1 | 4/2007 | Wang et al. | |
| 2009/0294128 | A1* | 12/2009 | Dale | E21B 33/127 166/306 |
| 2013/0277053 | A1 | 10/2013 | Yeh et al. | |
| 2014/0008066 | A1 | 1/2014 | Least et al. | |
| 2014/0014314 | A1* | 1/2014 | Cunningham | E21B 43/04 166/51 |
| 2014/0262208 | A1 | 9/2014 | Cunningham et al. | |
| 2015/0233216 | A1 | 8/2015 | Rodrigue et al. | |
| 2016/0265318 | A1 | 9/2016 | Greci et al. | |

OTHER PUBLICATIONS

PCT Application No. PCT/US2018/068170 , International Search Report and Written Opinion, dated Sep. 26, 2019, 13 pages.

* cited by examiner

*Primary Examiner* — D. Andrews
*Assistant Examiner* — Yanick A Akaragwe
(74) *Attorney, Agent, or Firm* — Kilpatrick Townsend & Stockton LLP

(57) ABSTRACT

A shunt system for a wellbore includes a first set of tubes defining a first plurality of fluid paths and a second set of tubes defining a second plurality of fluid paths. The shunt system also includes a mixing chamber positioned between the first set of tubes and the second set of tubes to allow slurry from the first plurality of fluid paths to mix together prior to outputting the slurry to the second set of tubes. Further, the shunt system is positionable external to one or more sand screens.

18 Claims, 4 Drawing Sheets

SHUNT TUBE SYSTEM FOR GRAVEL PACKING OPERATIONS

TECHNICAL FIELD

The present disclosure relates to shunt tube systems used in gravel packing operations of hydrocarbon well systems. More specifically, this disclosure relates to mixing chambers positioned between sections of shunt tubing in the shunt tube systems used in the gravel packing operations that are external to sand screens.

BACKGROUND

In hydrocarbon-producing wells, sand screens may be used to filter sand and other debris from production fluids produced from the hydrocarbon well to a surface. To further filter the sand and other debris from the production fluids, an annulus between the sand screen and a wall of the hydrocarbon well may be packed with gravel, sand, or proppant. The gravel, sand, or proppant for a gravel pack filling the annulus may be provided to an appropriate location using multiple shunt tubes. If one of the shunt tubes become blocked or otherwise unusable, a gravel packing operation may continue with one less usable shunt tube. Completing the gravel packing operation with one less usable shunt tube may result in an increase in friction losses in the remaining shunt tubes, and the increased friction losses may limit a maximum achievable gravel packing length of the gravel packing operation.

DETAILED DESCRIPTION

Figure 1:
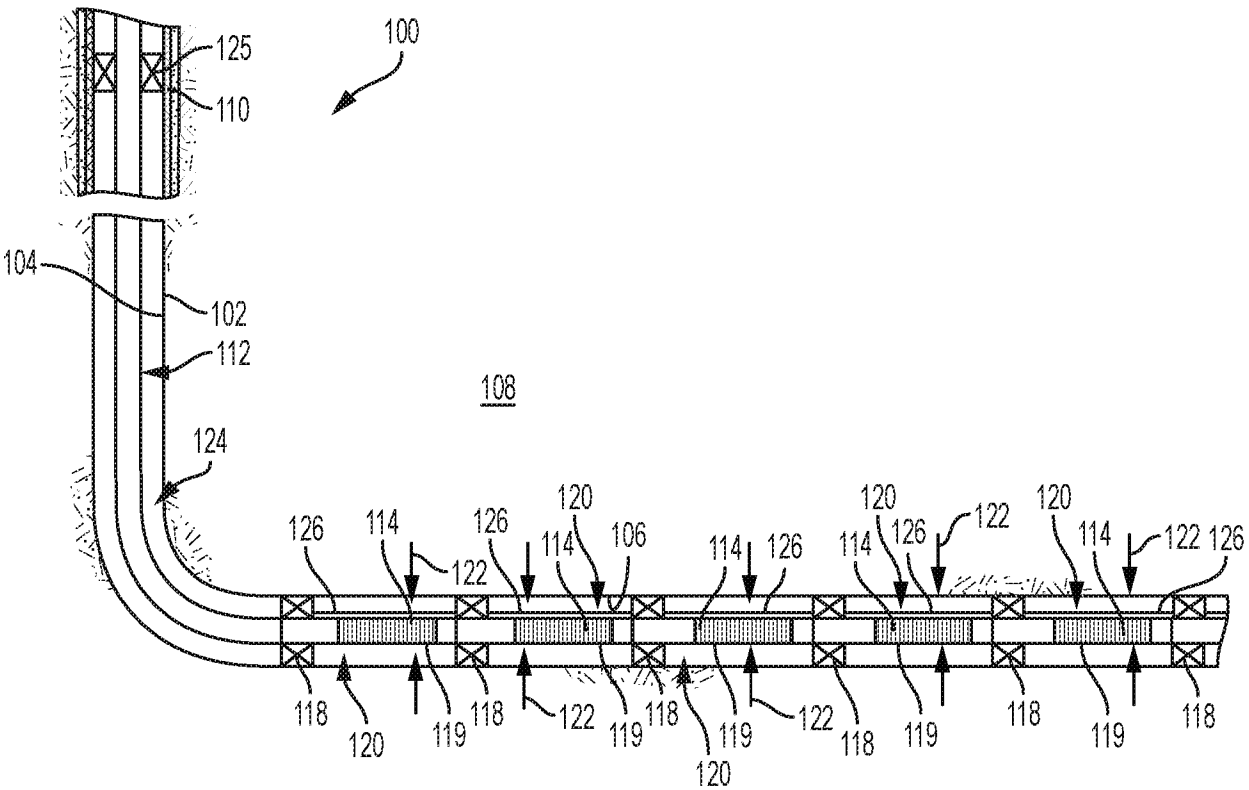
FIG. 1 is a cross-sectional view of an example of a well system that includes a series of sand screens with a shunt system according to some aspects of the present disclosure.

Certain aspects and examples of the disclosure relate to shunt tube systems used for gravel packing operations within a wellbore that are positioned external to a sand screen assembly. Positioning the shunt tubes external to the sand screen assembly may increase an available size of the shunt tubes transporting slurry for the gravel packing operation without occupying space within a tubular of the sand screen assembly used to produce wellbore fluids to a surface of a wellbore. In an example, slurry is defined as a clean carrier fluid with concentrations of particulate (e.g., gravel, sand, or proppant) suspended within the clean carrier fluid. The shunt tube system may include a mixing chamber positioned external to a joint between two sand screen assemblies. In another example, the mixing chamber may be positioned external to a sand screen assembly or in any other external location in relation to the sand screen assembly. Transmission tubes of the shunt system may couple to jumper tubes of the mixing chamber to provide paths for ingress and egress of slurry to and from the mixing chamber.

Providing a mixing chamber between two sections of transmission tubes enables mixing of the slurry from multiple parallel transmission tubes at defined intervals. Accordingly, any imbalances in slurry proppant concentration between the multiple parallel transmission tubes may be reduced when the slurry fluids from the multiple parallel transmission tubes are mixed in the mixing chamber and output to downhole sets of parallel transmission tubes. Further, the mixing chamber may enable a bypass of a plug in one of the transmission tubes resulting from a buildup of proppant in the transmission tube. Bypassing the plug with the mixing chamber enables the slurry to continue flowing through the downhole sets of parallel transmission tubes. Providing the bypass to the plug may reduce friction losses in the shunt tube system and improve a maximum achievable gravel packing length by reestablishing a maximum total number of usable transmission tubes after the mixing chamber when one of the transmission tubes along a previous section of a sand screen was rendered unusable due to the plug.

Balancing proppant concentrations of transmission tubes and bypassing a plugged transmission tube may result in increased reliability of the shunt tube system. Accordingly, implementing the shunt tube system described herein may result in increases in consistency of a gravel pack around a sand screen within a wellbore. Further, the shunt tube system may provide an increase in reliability of a gravel packing operation within the wellbore.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a well system 100 according to some aspects. The well system 100 may include a wellbore 102 with a generally vertical section 104 that transitions into a generally horizontal section 106 extending through a subterranean earth formation 108. In an example, the vertical section 104 may extend in a downhole direction from a portion of the wellbore 102 having a cemented in casing string 110. A tubular string, such as a production tubing string 112, may be installed or extended into the wellbore 102.

One or more sand screens 114 and one or more packers 118 may be interconnected along the production tubing string 112, such as along tubulars 119 positioned along the horizontal section 106 of the wellbore 102. The tubulars 119 may be attached to a downhole end of the production tubing string 112. The packers 118 may seal an annulus 120 located between the tubulars 119 and walls of the wellbore 102. As a result, fluids 122 may be produced from multiple intervals or "pay zones" of the formation 108 through isolated portions of the annulus 120 between adjacent pairs of packers 118.

In an example, the sand screens 114 may be positioned between pairs of the packers 118. The sand screens 114 may be any type of sand screens that are coupled to the tubulars 119 mechanically or with an adhesive material. In operation, the sand screen 114 may filter the fluids 122 flowing into the tubulars 119 from the formation 108 and through the annulus 120.

While the well system 100 is described as including multiple tubulars 119 and multiple packers 118, these described components may not be used in every example in which the sand screen 114 is used. For example, the well system 100 may include only an individual tubular 119. Further, an example using the sand screen 114 may be implemented without the packers 118 isolating the various sections of the formation 108.

To assist the sand screens with filtering the fluids 122 from the formation 108, the well system 100 may also include a shunt system 126. The slurry may be diverted from the production string 112 (e.g., using a closing sleeve (not shown)) to an annulus 124 between a wall of the wellbore 102 and the production tubing string 112 when the slurry is at a location within the production tubing string 112 downhole from a gravel pack packer 125. From the annulus 124, the slurry is received by the shunt system 126 that functions to both transmit the slurry further downhole and to deposit the slurry around the sand screens 114 to generate a gravel pack within the annulus 120. The shunt system 126, which is positioned external to the sand screens 114, is described in further detail below with respect to FIGS. 2-4. The gravel pack generated in the annulus 120 by the shunt system 126 may assist the sand screen 114 in preventing the production of fine particulate or sand from the formation 108. For example, the gravel pack in the annulus 120 may prevent migration of formation materials from the formation 108 into the tubular 119. Further, because the shunt system 126 is positioned external to the sand screens 114, the tubes associated with the shunt system 126 may be larger because the tubes do not take up any space used to produce the production fluid from the wellbore 102.

Figure 2:
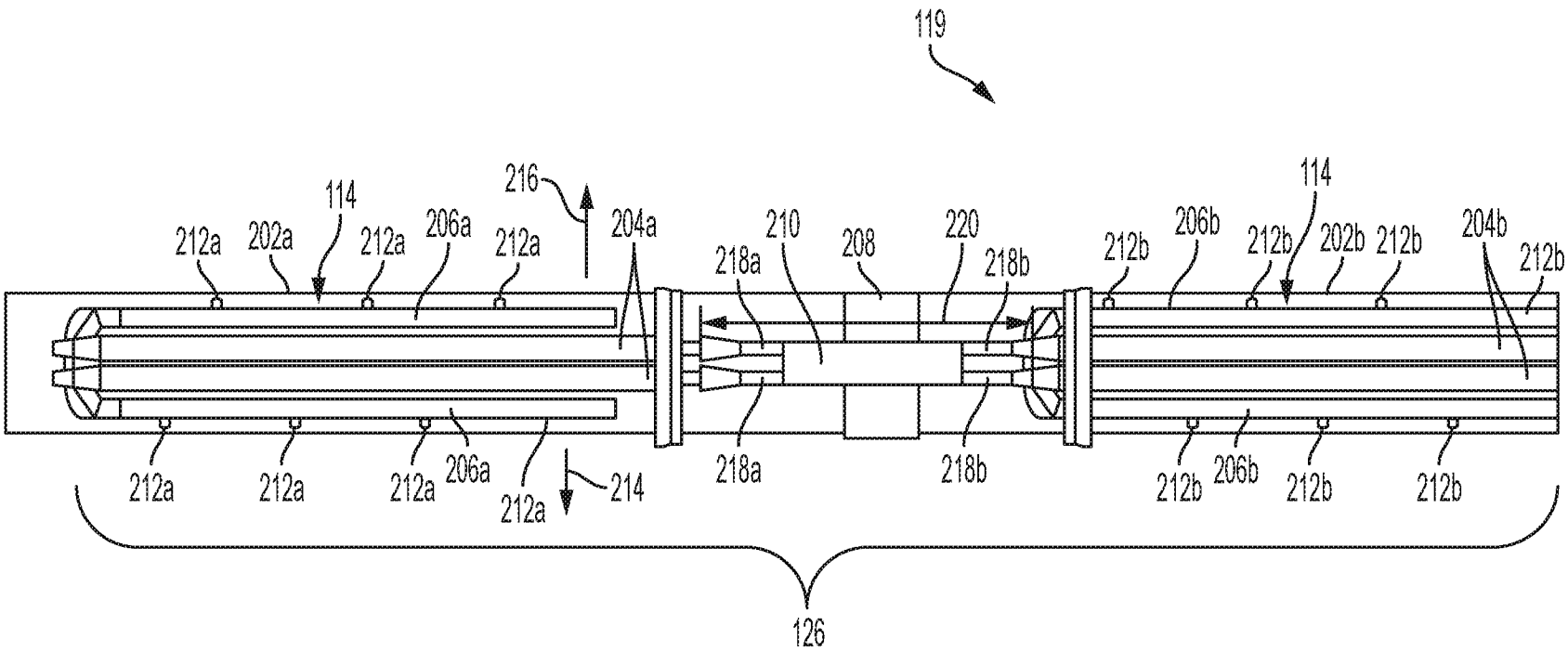
FIG. 2 is a side view of the shunt system of FIG. 1 positioned externally along a portion of a sand screen tubular according to some aspects of the present disclosure.

FIG. 2 is a side view of the shunt system 126 positioned externally along a portion of the tubular 119 including the sand screens 114 according to some aspects. As illustrated, portions of the tubular 119 between the packers 118 may include multiple sand screen sections 202*a* and 202*b*. Accordingly, the shunt system 126 may include sets of transport tubes 204*a* and 204*b* and packing tubes 206*a* and 206*b* that correspond with the respective sand screen sections 202*a* and 202*b*. To span a joint 208 between the sand screen sections 202*a* and 202*b*, a mixing chamber 210 may be installed between the transport tubes 204*a* and the transport tubes 204*b*. The mixing chamber 210 may also be positioned in other locations such as directly above one of the sand screens 114.

In an example, the transport tubes 204*a* may receive the slurry from the annulus 124 or from an additional uphole mixing chamber (not shown). As the slurry travels into the transport tubes 204*a*, some of the slurry may be diverted into the packing tubes 206*a*. The slurry diverted into the packing tubes 206*a* may exit the packing tubes 206*a* at slurry distributors 212*a*. In an example, the transport tubes 204*a* include a cross-sectional area that is larger than a cross-sectional are of the packing tubes 206*a*.

The slurry distributors 212*a* may be holes or nozzles installed along a length of the packing tubes 206*a*. In an example, the slurry distributors 212*a* may allow the slurry to exit the packing tubes 206*a* such that the slurry fills the annulus 120 surrounding the tubular 119. The slurry that fills the annulus 120 may be referred to as a gravel pack. Additionally, a portion of the tubular 119 positioned under the packing tubes 206*a* (e.g., on a side of the tubular 119) may be a location of the sand screens 114. Thus, the gravel pack distributed by the packing tubes 206*a* may work in conjunction with the sand screens 114 to filter unwanted debris from the fluids 122 produced through the production tubing string 112.

Continuing with the example, the shunt system 126 may include the transport tubes 204*b* positioned further downhole within the wellbore 102 than the transport tubes 204*a*. The transport tubes 204*b* may receive mixed slurry from the mixing chamber 210, and the mixing chamber 210 may receive unmixed slurry from the individual transport tubes 204*a*. Because of the relative positioning of the transport tubes 204*a* within the wellbore 102, leak-off of clean fluid from the slurry may be more prevalent in a transport tube 204*a* with slurry distributors 212*a* positioned facing a direction 214 toward a lower wall of the wellbore 102 than the slurry distributors 212*a* positioned facing a direction 216 toward an upper wall of the wellbore 102. The additional clean fluid leak-off experienced by the transport tube 204*a* feeding the slurry distributors 212*a* facing the direction 214 may result in a difference in proppant concentration between the slurry in the two parallel transport tubes 204*a*, especially over a length of an entire shunt system 126. Accordingly, when the unmixed slurry enters the mixing chamber 210 at differing proppant concentrations from the transport tubes 204*a*, the mixing chamber 210 may mix the unmixed slurry to provide a more uniform proppant concentration in a mixed slurry provided to the transport tubes 204*b*.

Mixing the slurry at the mixing chamber 210 may provide each new downhole section of transport tubes 204*b* with similar concentrations of proppant within the slurry. Because of the mixing of slurry within the mixing chamber 210, the slurry in one branch of the transport tubes 204*b* may avoid becoming more proppant laden than another branch of the transport tubes 204*b* due to clean fluid leak-off based on an orientation of the slurry distributors 212. Accordingly, the likelihood of the transport tubes 204 plugging with proppant prematurely is reduced when compared to a shunt system without the mixing chamber 210.

Further, the mixing chamber 210 may provide a slurry bypass when one of the transport tubes 204 is plugged with proppant. For example, when one of the transport tubes 204*a* is plugged with proppant, the remaining transport tube 204*a* may still deliver the slurry to the mixing chamber 210. While the mixing chamber 210 may not mix the slurry from the two transport tubes 204*a* in such an example, the mixing chamber 210 may provide both of the transport tubes 204*b* with the slurry for continued distribution of the slurry to generate gravel packs at downhole locations of the annulus 120.

As with the transport tubes 204*a*, as the slurry travels into the transport tubes 204*b* from the mixing chamber 210, some of the slurry may be diverted into the packing tubes 206*b*. The slurry diverted into the packing tubes 206*b* may exit the packing tubes 206*b* at slurry distributors 212*b*. In an example, the transport tubes 204*b* include a cross-sectional area that is larger than a cross-sectional are of the packing tubes 206*b*.

The slurry distributors 212*b* may be holes or nozzles installed along a length of the packing tubes 206*b*. In an example, the slurry distributors 212*b* may allow the slurry to exit the packing tubes 206*b* such that the slurry is able to fill the annulus 120 surrounding the tubular 119. The slurry and deposited gravel that fills the annulus 120 may be referred to as a gravel pack. Additionally, a portion of the tubular 119 positioned under the packing tubes 206*b* (e.g., on the tubular side of the packing tubes 206*b*) may be a location of the sand screens 114. Thus, the gravel pack distributed by the packing tubes 206*b* may work in conjunction with the sand screens 114 to filter unwanted debris from the fluids 122 produced through the production tubing string 112.

Further, the mixing chamber 210 may be fluidly coupled to the transport tubes 204*a* and 204*b* using jumper tubes 218*a* and 218*b*. The jumper tubes 218*a* and 218*b* may telescope or be otherwise adjustable such that the mixing chamber 210 and the jumper tubes 218*a* and 218*b* span a distance 220 between the transport tubes 204*a* and the transport tubes 204*b*. Moreover, while FIG. 2 depicts the shunt system 126 including two parallel transport tubes 204*a* attached the two parallel jumper tubes 218*a* of the mixing chamber 210 and two parallel transport tubes 204*b* attached to the two parallel jumper tubes 218*b* of the mixing chamber 210, more or fewer transport tubes 204 and jumper tubes 218 may be included in the shunt system 126. For example, the two transport tubes 204*a* may provide slurry to the mixing chamber 210, but the mixing chamber 210 may output the mixed slurry to only a single transport tube 204*b*. In another example, the shunt system 126 may include three or more transport tubes 204*a* that provide slurry to the mixing chamber 210, and the shunt system 126 may also include three or more transport tubes 204*b* that receive the mixed slurry from the mixing chamber 210.

In an additional example, one or more additional shunt systems 126 may be positioned around the tubular 119. In such an example, additional sets of transport tubes 204*a* and 204*b*, sets of packing tubes 206*a* and 206*b*, sets of jumper tubes 218*a* and 218*b*, and mixing chambers 210 are positioned along the tubular 119 for distribution of slurry around the sand screens 114 of the tubular 119. Other numbers and arrangements of transport tubes 204, packing tubes 206, jumper tubes 218, and mixing chamber 210 are also contemplated within the scope of the present disclosure.

While the mixing chamber 210 is generally described as being positioned between the jumper tubes 218*a* and 218*b* and spanning the joint 208 between the sand screen sections 202*a* and 202*b*, the mixing chamber 210 may be positioned at other locations along the shunt system 126. In an example, the mixing chamber 210 may be integrated with the transport tubes 204 (e.g., at a position that halves the transport tubes 204) while the jumper tubes 218 span the joint 208 between the sand screen sections 202*a* and 202*b*. In another example, the mixing chamber 210 may be integrated with the transport tubes 204 (e.g., at the position that halves the transport tubes 204) and an additional mixing chamber 210 may be positioned between the jumper tubes 218*a* and 218*b* and spanning the joint 208 between the sand screen sections 202*a* and 202*b*.

Figure 3:
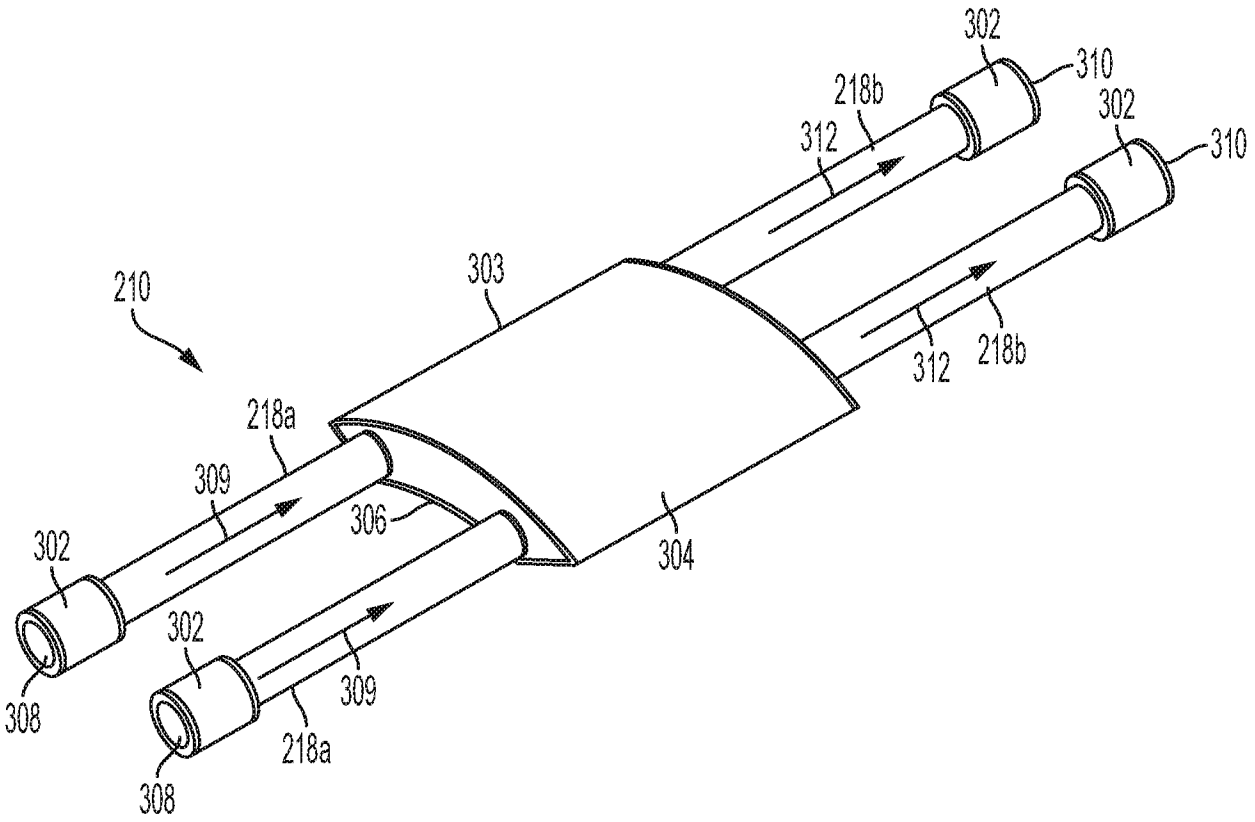
FIG. 3 is a perspective view of a mixing chamber of the shunt system of FIG. 2 according to some aspects of the present disclosure.

FIG. 3 is a perspective view of the mixing chamber 210 of the shunt system 126 according to some aspects of the present disclosure. As discussed above with respect to FIG. 2, the mixing chamber 210 may include or otherwise be attached to jumper tubes 218*a* and 218*b*. In another example, the mixing chamber 210 may be coupled directly to transport tubes 204*a* and 204*b* over one of the sane screens 114, for example. The jumper tubes 218*a* and 218*b* may be telescopically extendable or otherwise adjustable such that ends 302 of the jumper tubes 218*a* and 218*b* are able to mate with ends of the transport tubes 204*a* and 204*b*. For example, the jumper tubes 218*a* and 218*b* may each include two or more concentric tubes that provide telescoping functionality of the jumper tubes 218*a* and 218*b* while maintaining structural integrity of the jumper tubes 218*a* and 218*b* during transmission of slurry to and from the mixing chamber 210. In one or more examples, the jumper tubes 218*a* and 218*b* may be cylindrical tubes or rectangular tubes. Further, the jumper tubes 218*a* and 218*b* may be coupled to the transport tubes 204*a* and 204*b* using a threaded connection, a quick connector, or any other type of suitable connector.

A housing 303 of the mixing chamber 210 may span a gap between the jumper tubes 218*a* and 218*b* in any shape. In another example, the housing 303 may extend between two transport tubes 204*a* or 204*b* directly over one of the sand screens 114. As illustrated, an overhead outline of the housing 303 is rectangular. However, other overhead outline shapes are also contemplated (e.g., circular, oval-shaped, rounded edges, etc.). Further, the example of the housing 303 depicted in FIG. 3 includes a rounded outer surface 304 (i.e., the surface closest to the wall of the wellbore 102) and a rounded inner surface 306 (i.e., the surface closest to the tubular 119). A radius of an arc along which the outer surface 304 tracks may be such that the outer surface 304 maintains a constant shortest distance between the outer surface 304 and the tubular 119. Likewise, a radius of an arc along which the inner surface 306 tracks may also maintain a constant shortest distance between the inner surface 306 and the tubular 119. However, in other embodiments, the outer surface 304 and the inner surface 306 may not include any curvature. For example, the outer surface 304 and the inner surface 306 may be flat such that the housing 303 is in the shape of a rectangular prism.

In one or more examples, an interior of the mixing chamber 210 may be empty. That is, the mixing chamber 210 may include a hollow inner cavity. In another example, blades or baffles may be positioned within the mixing chamber 210 to encourage mixing of the slurry received by the mixing chamber 210 after traveling from inlet ports 308 along inlet fluid paths 309. Upon mixing within the mixing chamber 210, the mixed slurry may travel to the outlet ports 310 along outlet fluid paths 312 toward the transport tubes 204*b* positioned downhole from the mixing chamber 210.

Figure 4:
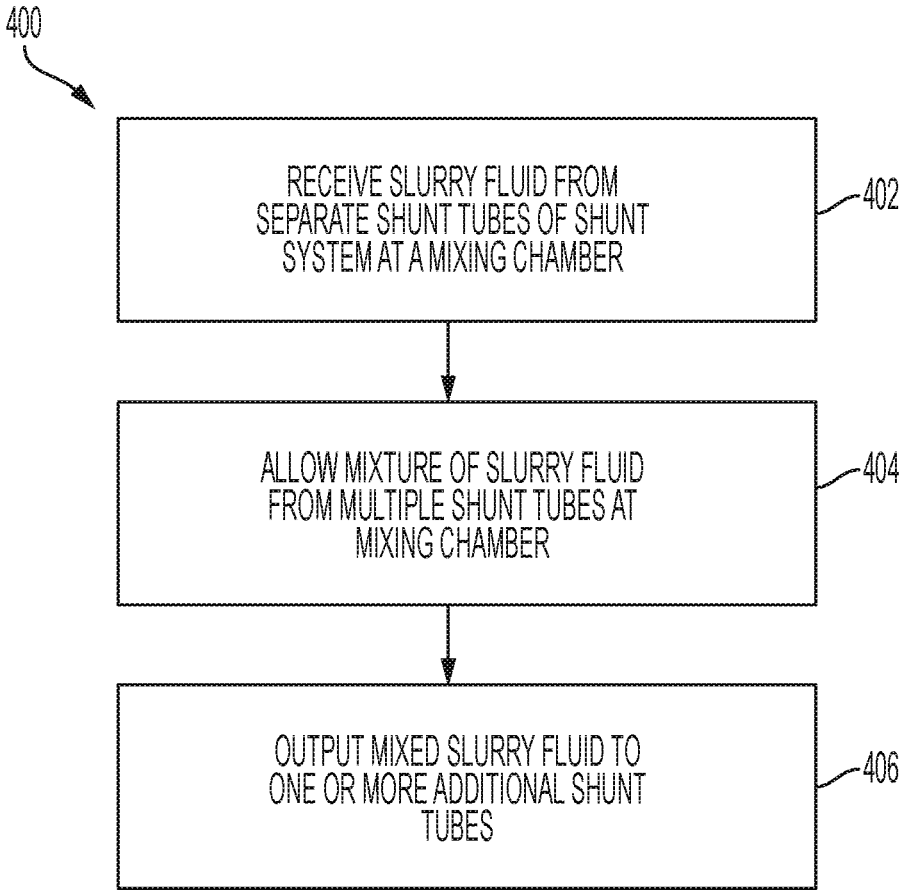
FIG. 4 is a flowchart of a process for mixing slurry within the shunt system of FIG. 1 according to some aspects of the present disclosure.

FIG. 4 is a flowchart of a process 400 for mixing slurry within the shunt system 126 that is externally mounted to the sand screen sections 202*a* and 202*b* according to some aspects. At block 402, the process 400 involves receiving slurry from separate shunt tubes (e.g., the jumper tubes 218*a*) of the shunt system 126 at the mixing chamber 210 that is positioned external to the joint 208 between the sand screen sections 202*a* and 202*b*. As discussed above with respect to FIG. 2, the slurry received from the separate shunt tubes may include varying clean fluid to proppant ratios. That is, one of the shunt tubes may provide slurry that experienced a greater amount of clean fluid leak-off than the other shunt tube. In another example, one of the shunt tubes may not receive any slurry from an associated transport tube 204*a* that is plugged by a buildup of proppant (e.g., due to clean fluid lead-off). In either example, the separate shunt tubes may provide slurry of varying quantities (i.e., different flow rates) and varying clean fluid to proppant ratios.

At block 404, the process 400 involves allowing slurry from the multiple shunt tubes (e.g., the jumper tubes 218*a*) to mix at the mixing chamber 210. For example, the slurry may enter the mixing chamber from the multiple jumper tubes 218*a* at different flow rates and proppant concentrations. Once in the mixing chamber 210, the slurry fluids from the multiple jumper tubes 218*a* are encouraged to mix. The encouragement to mix may be provided generally by an open space that allows the slurry fluids to mix. Blades, baffles, or other protuberances may also be positioned within the mixing chamber 210 to generate turbulence that further encourages mixing.

At block 406, the process 400 involves outputting the mixed slurry to one or more additional shunt tubes (e.g., the jumper tubes 218*b*). As the slurry mixes within the mixing chamber 210, the slurry is transported toward the jumper tubes 218*b*. At the jumper tubes 218*b*, the mixed slurry may be output toward the transport tubes 204*b*. In an example, the mixed slurry provided to the jumper tubes 218*b* may have similar proppant concentrations and similar flow rates due to the mixing of the slurry in the mixing chamber 210.

As the mixed slurry is provided to the transport tubes 204*b*, a portion of the mixed slurry in each of the transport tubes 204*b* may be redirected to the packing tubes 206*b*. At the packing tubes 206*b*, the mixed slurry is distributed into the annulus 120 between the tubular 119 and a wall of the wellbore 102. The distributed mixed slurry generates a gravel pack within the annulus 120.

In some aspects, systems, devices, and methods for implementing and operating a shunt system for gravel packing operations within a wellbore are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a shunt system for a wellbore, the shunt system comprising: a first set of tubes defining a first plurality of fluid paths; a second set of tubes defining a second plurality of fluid paths; and a mixing chamber positioned between the first set of tubes and the second set of tubes to allow slurry from the first plurality of fluid paths to mix together prior to outputting the slurry to the second set of tubes, the shunt system being positionable external to one or more sand screens.

Example 2 is the shunt system of example 1, wherein the mixing chamber comprises a first set of jumper tubes attached to the first set of tubes and a second set of jumper tubes attached to the second set of tubes.

Example 3 is the shunt system of examples 1 to 2, wherein the first set of tubes and the second set of tubes comprise transport tubes being positionable to transport the slurry through the shunt system.

Example 4 is the shunt system of examples 1 to 3, further comprising: a first set of transport tubes and a second set of transport tubes, wherein the first set of tubes and the second set of tubes are jumper tubes mate with the first set of transport tubes and the second set of transport tubes.

Example 5 is the shunt system of examples 1 to 4, wherein the first set of tubes comprises: at least two transport tubes being positionable to transport the slurry to the mixing chamber; and at least two packing tubes being positionable to transport the slurry to an annulus between the one or more sand screens and a wall of the wellbore.

Example 6 is the shunt system of example 5, wherein the second set of tubes comprises: at least two additional transport tubes being positionable to receive a mixed slurry from the mixing chamber; and at least two additional packing tubes being positionable to transport the mixed slurry to the annulus between the one or more sand screens and the wall of the wellbore.

Example 7 is the shunt system of examples 5 to 6, wherein the at least two packing tubes comprise a first cross-section with a first cross-sectional area, and the at least two transport tubes comprise a second cross-section with a second cross-sectional area that is larger than the first cross-sectional area.

Example 8 is the shunt system of examples 5 to 7, wherein a first packing tube of the two packing tubes is fluidly coupled to a first transport tube of the two transport tubes; and a second packing tube of the two packing tubes is fluidly coupled to a second transport tube of the two transport tubes.

Example 9 is the shunt system of examples 1 to 8, wherein the mixing chamber is positionable external to a joint between two sand screens of the one or more sand screens.

Example 10 is a mixing chamber for a shunt system for delivering slurry to sand screens, the mixing chamber comprising: a first inlet port for a first tube defining a first inlet fluid path; a second inlet port for a second tube defining a second inlet fluid path; a first outlet port for a third tube defining a first outlet fluid path; a second outlet port for a fourth tube defining a second outlet fluid path; and a housing defining an area in which fluid from the first inlet fluid path and the second inlet fluid path is mixable prior to flowing through the first outlet port or the second outlet port, wherein the mixing chamber is positionable external to one or more sand screens.

Example 11 is the mixing chamber of example 10, wherein the mixing chamber is positionable over a joint between two sand screens of the one or more sand screens.

Example 12 is the mixing chamber of examples 10 to 11, wherein the first inlet port and the second inlet port are positionable to receive slurry from a first transport tube and a second transport tube, and the first outlet port and the second outlet port are positionable to transmit slurry to a third transport tube and a fourth transport tube.

Example 13 is the mixing chamber of examples 10 to 12, wherein the first tube, the second tube, the third tube, and the fourth tube comprise telescoping jumper tubes that are positionable to extend between the housing and a set of transport tubes.

Example 14 is the mixing chamber of examples 10 to 13, wherein the housing comprises an inner surface curvature and an outer surface curvature that are each positionable to maintain a constant shortest distance of an inner surface and an outer surface of the housing to the one or more sand screens.

Example 15 is the mixing chamber of examples 10 to 14, wherein the first outlet port and the second outlet port are positioned in relation to the housing such that the first outlet port and the second outlet port receive substantially similar amounts of the slurry from the housing.

Example 16 is the mixing chamber of examples 10 to 15, wherein the housing comprises blades or baffles positioned within the area to encourage mixing of the fluid from the first inlet fluid path and the second inlet fluid path.

Example 17 is a method comprising: pumping slurry through separate tubes to a mixing chamber; allowing the slurry from the separate tubes to mix in the mixing chamber that is external to one or more screens; and outputting mixed slurry to one or more output tubes through outlet ports of the mixing chamber.

Example 18 is the method of example 17, wherein outputting the mixed slurry to the one or more output tubes comprises outputting the mixed slurry to one or more transport tubes and to one or more packing tubes.

Example 19 is the method of examples 17 to 18, further comprising: packing an annulus between the one or more screens and a wall of a wellbore with the mixed slurry.

Example 20 is the method of examples 17 to 19, wherein the separate tubes comprise at least two jumper tubes coupled between the mixing chamber and at least two transport tubes of a shunt system.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A shunt system for a wellbore, the shunt system comprising:

a first set of tubes defining a first plurality of fluid paths;

a second set of tubes defining a second plurality of fluid paths, the second set of tubes comprising:

at least one transport tube to receive a mixed slurry from a mixing chamber; and at least one packing tube directly coupled to the at least one transport tube to transport the mixed slurry from the at least one transport tube to an annulus between one or more sand screens and a wall of the wellbore; and the mixing chamber positioned between the first set of tubes and the second set of tubes to allow slurry from the first plurality of fluid paths to mix together prior to outputting the slurry to the second set of tubes, the shunt system being positionable external to the one or more sand screens.

2. The shunt system of claim 1, wherein the mixing chamber comprises a first set of jumper tubes attached to the first set of tubes and a second set of jumper tubes attached to the second set of tubes.

3. The shunt system of claim 1, wherein the first set of tubes and the second set of tubes comprise transport tubes being positionable to transport the slurry through the shunt system.

4. The shunt system of claim 1, further comprising:

a first set of transport tubes and a second set of transport tubes, wherein the first set of tubes and the second set of tubes are jumper tubes mate with the first set of transport tubes and the second set of transport tubes.

5. The shunt system of claim 1, wherein the first set of tubes comprises:

at least two transport tubes being positionable to transport the slurry to the mixing chamber; and at least two packing tubes being positionable to transport the slurry to an annulus between the one or more sand screens and a wall of the wellbore.

6. The shunt system of claim 5, wherein the at least two packing tubes comprise a first cross-section with a first cross-sectional area, and the at least two transport tubes comprise a second cross-section with a second cross-sectional area that is larger than the first cross-sectional area.

7. The shunt system of claim 5, wherein a first packing tube of the two packing tubes is fluidly coupled to a first transport tube of the two transport tubes, and a second packing tube of the two packing tubes is fluidly coupled to a second transport tube of the two transport tubes.

8. The shunt system of claim 1, wherein the mixing chamber is positionable external to a joint between two sand screens of the one or more sand screens.

9. A mixing chamber for a shunt system for delivering slurry to sand screens, the mixing chamber comprising:

a first inlet port for a first tube defining a first inlet fluid path;

a second inlet port for a second tube defining a second inlet fluid path;

a first outlet port for a third tube defining a first outlet fluid path;

a second outlet port for a fourth tube defining a second outlet fluid path; and a housing defining an area in which fluid from the first inlet fluid path and the second inlet fluid path is mixable prior to flowing through the first outlet port or the second outlet port to an annulus between one or more sand screens and a wall of a wellbore via one or more packing tubes directly couplable to a first transport tube or a second transport tube, the first transport tube couplable to the first outlet port for transporting the fluid from the housing to the one or more packing tubes, the second transport tube couplable to the second outlet port for transporting the fluid from the housing to the one or more packing tubes, wherein the mixing chamber is positionable external to the one or more sand screens.

10. The mixing chamber of claim 9, wherein the mixing chamber is positionable over a joint between two sand screens of the one or more sand screens.

11. The mixing chamber of claim 9, wherein the first inlet port and the second inlet port are positionable to receive slurry from a third transport tube and a fourth transport tube, and the first outlet port and the second outlet port are positionable to transmit slurry to the first transport tube and the second transport tube.

12. The mixing chamber of claim 9, wherein the first tube, the second tube, the third tube, and the fourth tube comprise telescoping jumper tubes that are positionable to extend between the housing and a set of transport tubes.

13. The mixing chamber of claim 9, wherein the housing comprises an inner surface curvature and an outer surface curvature that are each positionable to maintain a constant shortest distance of an inner surface and an outer surface of the housing to the one or more sand screens.

14. The mixing chamber of claim 9, wherein the first outlet port and the second outlet port are positioned in relation to the housing such that the first outlet port and the second outlet port receive substantially similar amounts of the slurry from the housing.

15. The mixing chamber of claim 9, wherein the housing comprises blades or baffles positioned within the area to encourage mixing of the fluid from the first inlet fluid path and the second inlet fluid path.

16. A method comprising:

pumping slurry through separate tubes to a mixing chamber;

allowing the slurry from the separate tubes to mix in the mixing chamber that is external to one or more screens;

outputting mixed slurry to one or more output tubes through outlet ports of the mixing chamber;

receiving the mixed slurry from the mixing chamber by one or more transport tubes, that are coupled to mixing chamber, of the one or more output tubes; and transporting the mixed slurry by one or more packing tubes of the one or more output tubes to an annulus between the one or more screens and a wall of a wellbore, the one or more packing tubes directly coupled to the one or more transport tubes for transporting the mixed slurry from the mixing chamber to the annulus.

17. The method of claim 16, further comprising:

packing the annulus between the one or more screens and the wall of the wellbore with the mixed slurry.

18. The method of claim 16, wherein the separate tubes comprise at least two jumper tubes coupled between the mixing chamber and at least two transport tubes of a shunt system.

* * * * *